US006185850B1

(12) United States Patent
Erkel

(10) Patent No.: US 6,185,850 B1
(45) Date of Patent: Feb. 13, 2001

(54) GOLF PAIRING APPARATUS AND METHOD OF USE

(76) Inventor: David Erkel, 12250 Abrams Rd., Suite 2128, Dallas, TX (US) 75243

( * ) Notice: Under 35 U.S.C. 154(b), the term of this patent shall be extended for 0 days.

(21) Appl. No.: 09/182,744

(22) Filed: Oct. 28, 1998

(51) Int. Cl.[7] ..... A47G 29/10
(52) U.S. Cl. ..... 40/657; 40/489; 40/621
(58) Field of Search ..... 40/657, 489, 600, 40/621

(56) References Cited

U.S. PATENT DOCUMENTS

| | | | |
|---|---|---|---|
| D. 369,625 | | 5/1996 | Nevels . |
| 3,168,787 | | 2/1965 | Surrey . |
| 3,460,281 | | 8/1969 | Levy . |
| 3,995,387 | * | 12/1976 | Lotts ..... 40/657 |
| 4,251,936 | | 2/1981 | Ferrell . |
| 4,530,177 | | 7/1985 | Kane . |
| 5,251,570 | | 10/1993 | Creech . |
| 5,694,881 | | 12/1997 | Creech . |

* cited by examiner

*Primary Examiner*—Terry Lee Melius
*Assistant Examiner*—William L. Miller
(74) *Attorney, Agent, or Firm*—Fulwider Patton Lee & Utecht, LLP

(57) ABSTRACT

An apparatus and method for pairing players in a golf tournament including a board with a display side having a plurality of groups bearing a predetermined number of slots. A plurality of magnetic name tag elements including a display space for receiving indicia associated with player to be paired are placed over selectively determined player slots providing a visual indication of occupied and unoccupied player slots. Changes in pairings that occur are responded to by moving corresponding name tag elements to different player slots.

12 Claims, 3 Drawing Sheets

GOLF PAIRING APPARATUS AND METHOD OF USE

BACKGROUND OF THE INVENTION

1. Field of the Invention

The invention relates generally to display devices and more specifically, to devices providing a visual indication of player pairings in a golf tournament.

2. Description of the Prior Art

Previous devices for displaying team participants and the outcomes of their competition are well known. One such device includes a tiered grid for monitoring the NCAA basketball tournament as sixty-four teams compete for a national title. For other events such as golf that involve a number of individuals competing to win a tournament but often playing in groups, large scoreboards have been developed to display player standings and their scores over the course of a four day tournament. Generally, the current player standings display the front runner and the respective scores accumulated over the course of a day. Summaries are often given of previous days efforts with a final tally being displayed as players finish the tournament. The main goal of these scoreboards is supplying a large enough display for a gallery to view from a distance while maintaining the standings throughout the tournament. As players improve or weaken their position, standings change and thus player names and associated need to be moved around the scoreboard to reflect the current standings. Thus player names and associated scores are often placed on large tiles that can be removed and relocated elsewhere on the board. What is not adequately addressed by these devices, however, is a means and method for initially providing a visual indication of player pairings as they develop and an easy to use method for changing player pairings without the need for a tournament coordinator.

Activities such as golf, whether played for leisure or for competition, often involve a number of players playing together over the course of several days and may taken place on different golf courses. At the start of a tournament player groupings are determined on the basis of similar competitive ability, random drawings, or by some other predetermined method. Thus at the start of a tournament player pairings are initially established to provide players with some indication of who they will be playing with or against as well as where and when to start. Even at the start of the event and especially during the course of the event, player pairings often change as individual competitors improve or weaken their position. When activities are not for competitive purposes, players may simply desire to change partners or conditions change requiring a player to switch with another player.

For example, in business settings large groups of personnel are often brought together for the enjoyment of leisurely activities such as a golf tournament. Generally a tournament coordinator is selected to pair and keep track of participants and the designated pairings. The tournament coordinator often keeps track of the pairings using a pen or pencil and a pad of paper as players indicate the group in which they desire to play.

Problems with this method arise in several situations. In the event the tournament coordinator is not available, changes can not be made. Players seeking information on the available pairing slots or current pairings are dependent on the tournament coordinator to display such information even when the coordinator is not present. Also, players unfamiliar with other participants may be hesitant in deciding which group in which they wish to play. Players may be given several days to establish the pairings. Player pairings change often as start times become unacceptable or different pairings become available through other player preferences. In a business setting, where time may be of the essence, participants may not have time to wait for the coordinator to bring up all the requested information and make the requested changes.

What is need and heretofore unavailable is an easy to use apparatus that displays all the relevant pairing information such as participants' names, current pairings, available openings, and provides for a simple method of changing the pairings prior to and throughout the tournament with or without the use of a tournament coordinator.

SUMMARY OF THE INVENTION

In accordance with a preferred embodiment of the present invention, an easy to use pairing apparatus is provided to display visual indications of available pairing openings and related tournament information and is characterized by a board element having one side as a display surface, a plurality of groups comprising a predetermined number of player slots, a to plurality of name tag elements for carrying indicia associated with players to be paired, and an attachment means for removably attaching the name tag elements to the board element.

The board element provides a metallic structure to removably attach magnetic name tag elements. Name slips having an indicia receiving side are provided and can be removably inserted in display spaces of the name tag elements.

Four player slots in each group accommodate a typical foursome in a golf tournament. Adjacent each group is a group indicator slot for labeling of each group by such criteria as team name, start time, or starting hole. As player pairings change due to player preferences or as a result of competition, players can move their associated name tag elements about the board. In this manner, anyone viewing the board will be able to determine the current pairings and any openings in groups they may wish to join.

An additional feature of the present invention is the addition of a queuing area capable of retaining the plurality of name tag elements in an organized arrangement. Name tag elements can be removed to and from the queuing area so that all players' indicia are provided a convenient location on the board.

Another feature of the present invention results in the spacing of the groups. To accommodate different courses, or a tournament occurring over the course of several days, or smaller groups of players, the board can be subdivided into different sections and marked as to each subdivisions criteria.

Other features and advantages of the present invention will become more apparent from the following detailed description of the invention, when taken in conjunction with the accompanying exemplary drawings.

Numerous advantages and aspects of the invention will be apparent to those skilled in the art upon consideration of the following detailed description which generally provides illustrations of the invention in its presently preferred embodiments.

DETAILED DESCRIPTION OF THE PREFERRED EMBODIMENT

Figure 1:
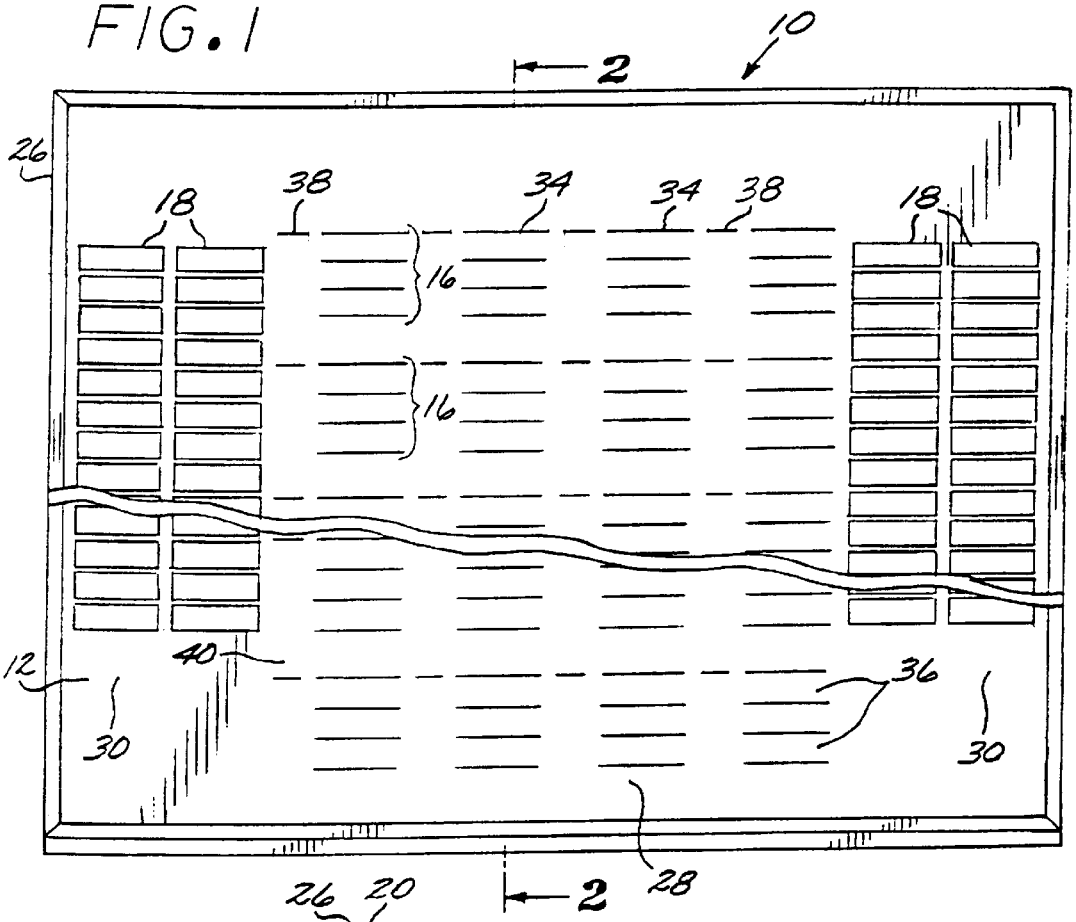
FIG. 1 is a front view of a pairing apparatus embodiment of the present invention.
Figure 2:
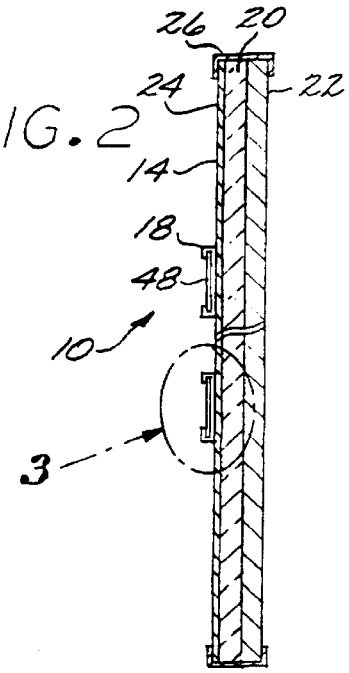
FIG. 2 is a broken vertical sectional view, in enlarged scale, taken along the line 2—2 of FIG. 1.

Referring now to FIGS. 1–2, a pairing apparatus, generally designated 10, provides for an easy to use means and method of visually indicating player pairings and changing thereof. The pairing apparatus generally includes a board 12 having a display surface 14 which provides a section for the layout of a plurality of groups 16 and placement of a plurality of name tag holders 18 which are removably adhered thereto.

The board 12 is a rectangular metallic front sheet 20 with a foam backing 22. The metallic front sheet is preferably formed of a ferrous based metal although other materials are also contemplated. Coating the metallic front structure is a layer of paint 24. The paint should preferably provide a strong contrast to any indicia to be placed thereon and should also preferably provide a surface that can be erased over the life of the product by such writing utensils as dry-erase markers. Other materials can be used to provide the contrasting background for example, porcelain has been found to provide the necessary background and eraseability.

Around the periphery of the board element is a frame 26 preferably made of a lightweight aluminum to decrease the overall weight of the pairing apparatus 10. The frame is basically channel shaped and partially surrounds a marginal area of the board element. The frame may also include an additional channel shaped projection (not shown) on the back side to accommodate hanging the board element from a vertical surface. While the board element 12 is not restricted in size, the preferred embodiment uses a overall of three feet and an overall width of two feet with the frame 26 extending about an inch in from the sides of the board element.

Overlaying the display side 14 of the board element 12 are a centrally located pairing area 28 and a marginally disposed queuing area 30 bordering the pairing area. Within the pairing area a plurality of groups 16 of a predetermined number of vertically aligned player slots 34 are arranged in several columns. Adjacent each player slot is player space 36. In the preferred embodiment, player spaces are located above each player slot. Next to each group 16 is a group indicator slot 38 and group indicator space 40. The group indicator slot is preferably placed in horizontal alignment and adjacent to the uppermost player slot 34 in each group and is clearly positioned to relay its attachment with its respective group. The group indicator space provides an area for the identification of each group or group indicator 41 under a predetermined criteria such as starting hole or starting time. These group indicators 41 may also refer to other groupings such as team name or the like.

In the preferred embodiment, pairings for an eighteen hole golf course having a front nine and a back nine best represented by an arrangement of the plurality of groups 16 in a table having four columns and nine rows. Thus the predetermined number of players slots is preferably four providing enough slots for a foursome as is common in a golf tournament. Each column represents a complete front nine holes or back nine holes on a regulation eighteen hole golf course and the use of four columns provides enough spaces for two complete golf courses, a two day tournament, or one hundred forty-four players allowing for eight players per hole at the start of the tournament.

The player slots 34 and indicator slots 38 are preferably screened onto the display surface 14 by means well known to one of ordinary skill in the art but other methods such as adhesives or burning a permanent grid onto the display surfaces are within the scope of this invention. The slots are preferably of a color chosen to contrast with the background on the display surface 14 of the board 12. As this invention is often used for golf tournaments, it is aesthetically preferable to provide player slots having a shade of green against a board with a white surface.

The queuing area 30 is preferably provided to allow for a temporary storage of a plurality of name tag elements 18. The queuing area is dimensioned to provide sufficient space to allow for the placement of one hundred forty-four name tag elements to fill every player slot 34 in the preferred embodiment. While a marginally disposed queuing area bordering a centrally located pairing area 28 has been described, the queuing area is not critical to the invention nor is the placement of the pairing and queuing areas relative to one another.

Figure 3:
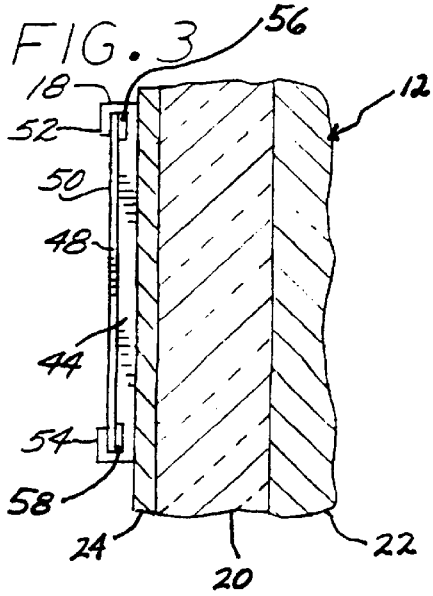
FIG. 3 is a detailed side view, in enlarged scale, taken from the oval 3 in FIG. 2.
Figure 4:
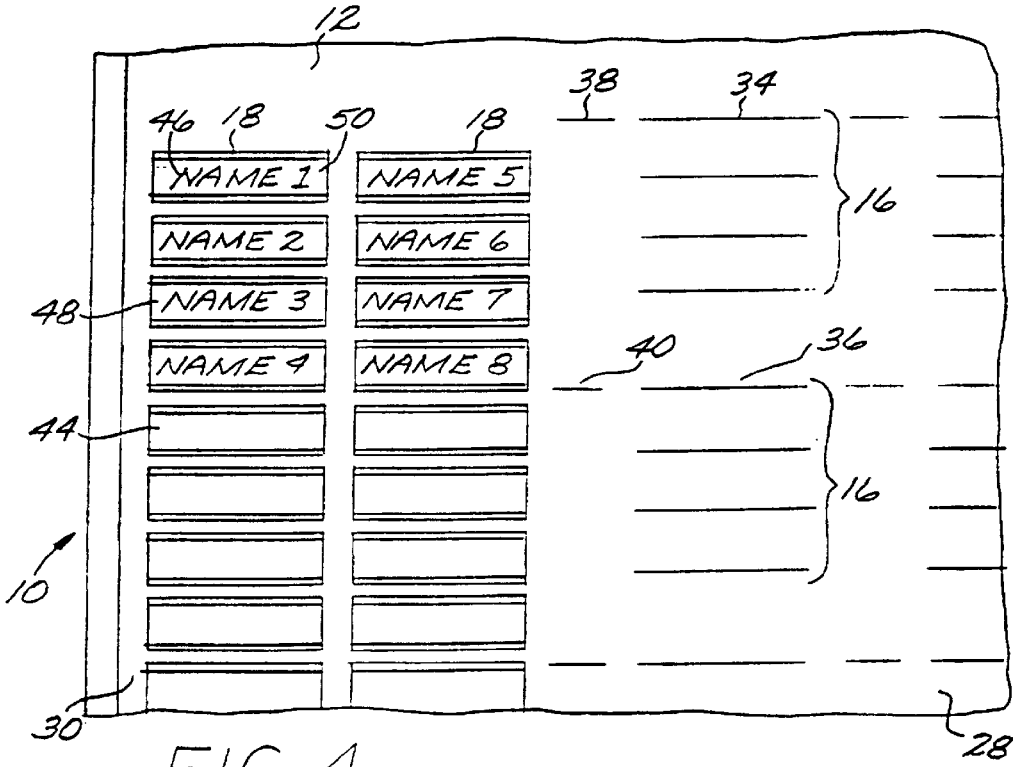
FIG. 4 is a partial front view, in enlarged scale, of the pairing apparatus shown in FIG. 1 illustrating an arrangement of name tag elements positioned in the queuing area.
Figure 5:
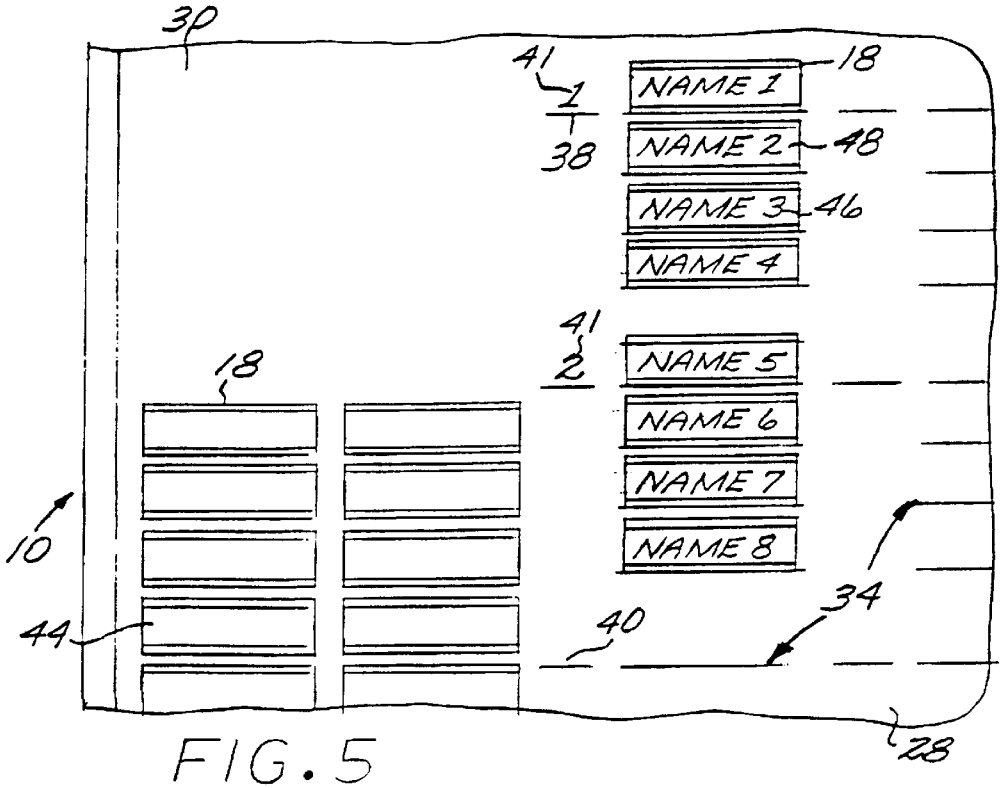
FIG. 5 is a front view similar to FIG. 4 illustrating the name tag elements removed from the queuing area and selectively positioned in groups of player slots.
Figure 6:
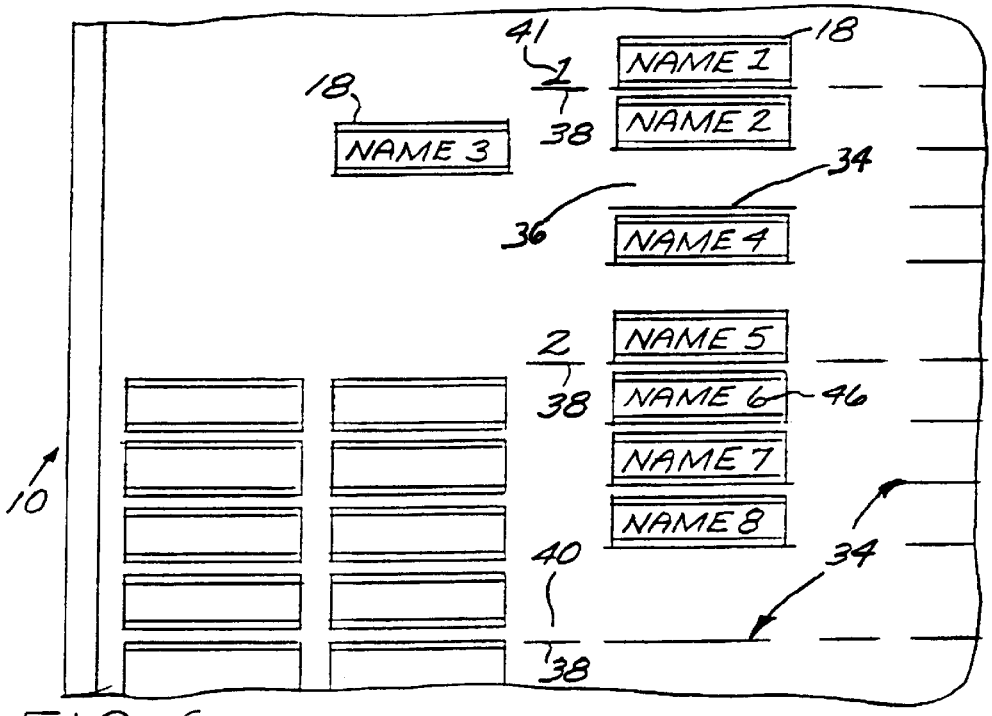
FIG. 6 is a front view similar to FIG. 5 depicting name tag elements removed from a player slot and placed back in the queuing area indicating an open pairing slot.
Figure 7:
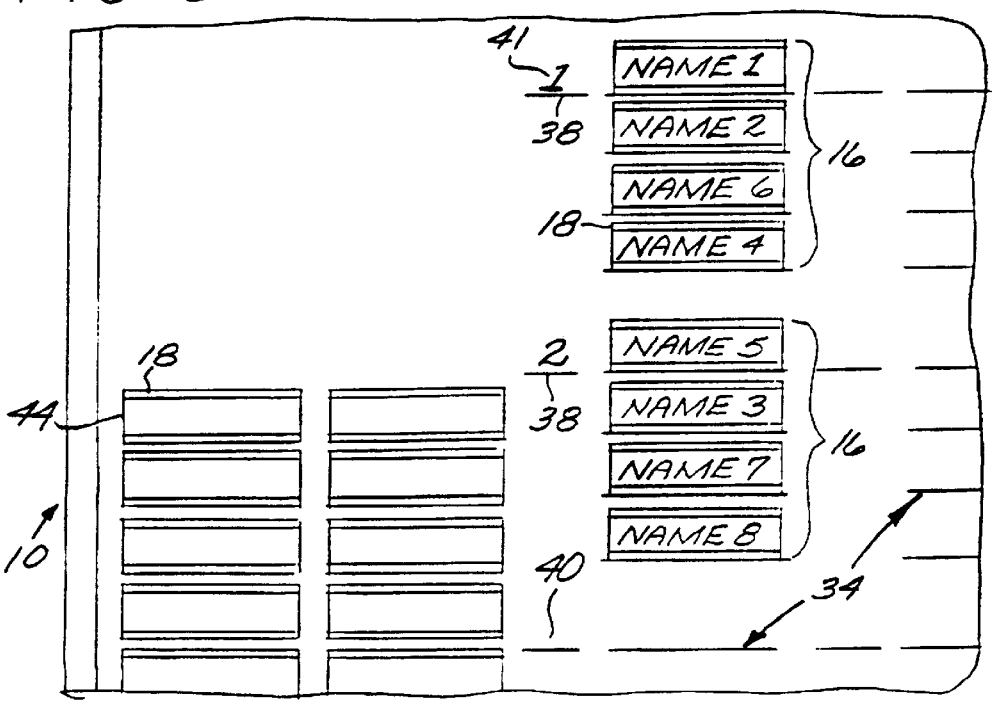
FIG. 7 is a front view similar to FIG. 6 illustrating a different arrangement of pairings in the player slots.

Referring to FIG. 3, the name tag holders 18 are generally channel shaped and include a display space 44 on the front side for the receipt of indicia 46 associated with each player. In the preferred embodiment, a name slip 48 having an indicia receiving side 50 is placed over the display space 44 and removably retained by an upper retainer lip 52 and a lower retainer lip 54. Each lip 52 and 54 projects forward from the face of the name tag element 18 and then turns inwardly to define an overhanging projection. The distance between the upper and lower retainer lips are sufficient to receive a name slip 48 while the respective overhanging projections act to retain the name slip against the face of the name tag element. Within each retainer lip 52 and 54 is a respective upper indentation 56 and lower indentation 58 that provide for better retention of the name slips 48 due to the curvature of the paper used for the name slips. The slips may also be shaped to complement the front face of the name tag holder thereby improving the friction fit of the slip therein.

The name tag element 18 is preferably constructed of a magnetic material providing for a releasable attachment means to the ferrous based metal board element 12. Alternatively, the board element 12 could be magnetic and a piece of ferrous based metal inserted into or adhered to a plastic extruded name tag element would provide similar attachment means. Other means such as the use of a hook and loop fastener or releasable adhesives or other fastening means well known in the art are also within the scope of this invention.

The name tag elements 18 are preferably dimensioned to be placed over selectively chosen player spaces 36 and in between adjacent player name slots 34. The display space 44 can itself be capable of receiving indicia or preferably a name slip 48 constructed of paper is placed over the display space. Simply writing the names with erasable marker in some cases is acceptable. Name slips can be constructed of a number of materials besides paper and can for example, be generated by a computer program and printer having label producing capabilities. In addition to using paper name slips, for example, materials with adhesive backings, whether permanent or releasable, as well as other means well known in the art are within the scope of this invention.

In use and operation, with reference to FIGS. 4–7, a pairing apparatus 10 including a board element 12 having a display surface 14 with a plurality of groups 16 of player slots 34, and a plurality of name tag elements 18 are provided. By way of illustration, players entering into the tournament are determined and corresponding player indicia 46 including such items as name and handicap are printed onto name slips 48. These name slips are then removably inserted into an individual name tag element 18 such that the indicia 46 is facing outwards. The name tag elements 18 are then placed in some arrangement such as alphabetical into the marginal queuing area 30 bordering the groups 16 of player slots 34. Group indicator slots 38 may then be filled in with predetermined group indicators 41 such as team names, starting holes, or starting tee times. The board may then be hung or displayed in a convenient location accessible to participants.

After scanning the board for openings, players desiring to be placed in a certain group may remove their respective magnetic name tag elements 18 from the queuing area 30 and removably attach the name tag element to the ferrous based metallic board 12 in an open player slot 34. Open player slots are filled in as more players determine which group they wish to play in. When a player wants to change groups or is dropped from a group, he or she places his name tag holder 18 back into the queuing area leaving an open player slot. This provides a visual indication to other players that there is an open pairing slot that needs to be filled. A player wishing to join a group having an opening as indicated by an open player slot has the opportunity to place his name tag holder in the open slot either from another group or from the queuing area thus effectively occupying the selected player slot. In this fashion, different pairings can be selectively determined by either the individual players as pairings change prior to or throughout the tournament.

Spacing between groups can be provided on the board 10 to allow for selective sectioning of the board. For example, if the tournament is being conducted on multiple golf courses or smaller groups of players are used or tee times carry over onto consecutive days, a section indicator can be drawn around selected groups 16 to provide for coverage of more than one set of players. Additional space may also be provided to display notes concerning the tournament such as the score at the end of play or for players to leave remarks about something tournament related. The board itself is lightweight and is easily transported to the tournament site to provide pairing information for the players as they arrive and accommodate different pairings as the tournament progresses.

While the present invention has been described herein in terms of a pairing apparatus for golf tournaments. Various changes and improvements may also be made to the invention without departing from the scope thereof. For example, other sports or events requiring pairings could benefit from the use of the present invention or a similar embodiment thereof.

What is claimed is:

1. Pairing apparatus for players in a tournament comprising:

a single board element formed with a planar display surface;

a plurality of columns overlying a first portion of said display surface, each of said columns including a plurality of spaced apart groups having four player slots and a player space adjacent each said slot;

an indicator slot positioned adjacent to one said player slot in each said group;

a plurality of rigid name tag elements dimensioned for selective positioning in a stacked relationship in respective ones of said player spaces in any one of said columns, each of said tag elements including a respective display space for receipt of an indicia associated with respective players to be paired;

a queuing area providing an open space overlying a second portion of said display surface complementing said first portion and providing temporary storage of said name tag elements and dimensioned to receive all of said name tag elements in said stacked relationship when said player spaces are uncovered; and each of said elements including releasable attachment means for releasably attaching the respective name tag elements to said board element in said player spaces in said columns whereby selected said indicia may be placed over the respective display spaces of the respective name tag elements and said name tag elements bearing said indicia placed on the respective player space of each such group to be releasably attached to said board element so that as pairing conditions change a selected said name tag element may be removed from said player space to have a portion of said open space uncovered indicating an available pairing opening.

2. Pairing apparatus as set forth in claim 1 wherein:

said attachment means includes a magnet.

3. Pairing apparatus as set forth in claim 1 wherein:

said slots and spaces are arranged in vertical columns.

4. Pairing apparatus as set forth in claim 1 wherein:

said name tag elements include removable name slips.

5. Pairing apparatus as set forth in claim 1 wherein:

said name tag elements are channel shaped.

6. Pairing apparatus as set forth in claim 1 wherein:

said board element is constructed with thirty-six said groups.

7. Pairing apparatus as set forth in claim 1 wherein:

said board element is constructed from a ferrous based metal.

8. Pairing apparatus as set forth in claim 1 wherein:

said display surface includes a painted white background.

9. Pairing apparatus as set forth in claim 1 wherein:

said groups are centrally arranged in a table having four columns by nine rows.

10. Method for pairing players throughout a tournament comprising the steps of:

providing a single display board having a planar display surface including a first portion partially covering said display surface with a plurality of columns including a plurality of spaced apart groups, each of said groups having at least four player slots placed adjacent an indicator slot and a second portion providing a queuing area complementing said first portion;

providing a plurality of rigid name tag elements representing the number of players in the tournament in said queuing area, said name tag elements having attachment means for removably positioning said name tag elements on said display board and further being dimensioned for placement within any of said player slots in any of said columns and further including exposed edges spaced away from said planar display surface and a display space for receiving indicia associated with players to be paired throughout the tournament;

providing indicia associated with each player;

placing said indicia in said display spaces of the respective said name tag elements;

providing a group indicator in each group indicator slot;

removing a selected said name tag element from said queuing area and placing said selected name tag element in a desired said player slot in any of said columns;

repeating the removal and placement step until each group of player slots is filled with respective said name tag elements corresponding to the number of players;

as pairing conditions change, grasping said edges of a selected said name tag element and removing it from a selected said player slot leaving an empty said player slot creating a visual indication of a pairing opening;

returning said selected name tag element to said queuing area;

filling said empty player slot with a different said name tag element to achieve an alternate pairing; and repeating said removing, returning and filling steps as necessary to complete each set of said player slots.

11. The method for pairing players throughout a tournament as set forth in claim 10 wherein:

said removal step includes grasping said exposed edges of said name tag element to be removed from said player slot and sliding said name tag element to an alternate location along said planar display surface.

12. Pairing apparatus for a predetermined number of players in a golfing tournament comprising:

a single board element formed at least partially with a ferrous based material and having a planar display surface including a pairing region and a storage region;

a set of four columns overlying said pairing region of said display surface providing a pairing area, each of said columns including a plurality of spaced apart groups having four vertically aligned player slots with a player space of a predetermined height and width adjacent each said slot;

an indicator slot positioned adjacent to one said player slot in each group;

a predetermined number of name tag elements corresponding with the predetermined number of players in the tournament, said name tag elements being dimensioned for selective positioning in stacked and covering relationship in respective ones of said player spaces, each of said name tag elements including a respective display space for receipt of an indicia associated with respective players to be paired;

a queuing column providing an open space overlying said storage region of said display surface and positioned marginally around said pairing region, said queuing column being dimensioned with a predetermined height and width to temporarily position all of said predetermined number of name tag elements in stacked relationship when all of said player spaces are uncovered; and each of said name tag elements including magnets cooperating with said ferrous board material to releasably attach the respective name tag elements to said board element in said player spaces in said columns whereby selected said indicia may be placed over the respective display spaces of the respective name tag elements and a selected said name tag element bearing said indicia is releasably placed on each of the respective player spaces in each group to form groups of pairing sets so that as pairing conditions change a selected said name tag element may be removed from its respective said player space and positioned in said queuing column to uncover an open space indicating an available pairing opening within said pairing region.

* * * * *